US006607053B1

(12) United States Patent
Warren

(10) Patent No.: US 6,607,053 B1
(45) Date of Patent: Aug. 19, 2003

(54) RETRACTABLE SAFETY CAGE

(76) Inventor: William Paul Warren, 10306 Campbell Rd., Marysville, IN (US) 47141

( * ) Notice: Subject to any disclaimer, the term of this patent is extended or adjusted under 35 U.S.C. 154(b) by 0 days.

(21) Appl. No.: 09/962,374

(22) Filed: Sep. 25, 2001

Related U.S. Application Data

(60) Provisional application No. 60/235,949, filed on Sep. 26, 2000.

(51) Int. Cl.[7] ..... E06C 7/18
(52) U.S. Cl. ..... 182/106
(58) Field of Search ..... 182/106, 93, 230

(56) References Cited

U.S. PATENT DOCUMENTS

| | | | | |
|---|---|---|---|---|
| 1,715,903 A | | 6/1929 | Dame | |
| 1,921,583 A | | 8/1933 | Reed | |
| 1,926,696 A | | 9/1933 | Murphy | |
| 2,539,664 A | | 1/1951 | Hay | |
| 2,614,744 A | * | 10/1952 | Hedglon | 182/106 |
| 2,923,373 A | * | 2/1960 | Ledgerwood | 16/33 |
| 2,957,542 A | | 10/1960 | Rizzuto | |
| 3,106,986 A | | 10/1963 | Ray | |
| 3,455,414 A | | 7/1969 | Higgins | |
| 3,598,200 A | | 8/1971 | Thompson | |
| 4,546,855 A | | 10/1985 | Lyons | |
| 4,643,274 A | | 2/1987 | Tataseo | |
| 4,688,768 A | * | 8/1987 | Lyons, Sr. | 182/106 |
| 5,282,339 A | | 2/1994 | Devlin et al. | |
| 5,931,258 A | | 8/1999 | Lorentz | |

FOREIGN PATENT DOCUMENTS

| | | |
|---|---|---|
| AU | 111229 | 8/1940 |

* cited by examiner

*Primary Examiner*—Alvin Chin-Shue
(74) *Attorney, Agent, or Firm*—Frost Brown Todd LLC; Robert H. Eichenberger

(57) ABSTRACT

A retractable safety cage is provided that occupies a minimum amount of vertical space within a manhole and which provides, in an extended position, a safety barrier surrounding the entrance to the manhole or ladder. A fixed upper periphery rail provides a substantially horizontal perimeter around the opening of the ladder. One or more floating periphery rails are suspended therefrom to provide additional perimeter blocking as well as additional support for the ladder user. The safety cage comprises two vertical members that are slideably received in a bracket that can be attached to either a ladder or a support wall. A counterbalance assists movement in the extending direction and slightly impedes movement in the retracting direction. The retractable safety cage can also be easily removed from the manhole by using a guide bracket with a coupling foot.

62 Claims, 15 Drawing Sheets

RETRACTABLE SAFETY CAGE

CROSS-REFERENCE TO RELATED APPLICATIONS

This application claims priority to U.S. Provisional Application Serial No. 60/235,949, filed Sep. 26, 2000.

BACKGROUND OF THE INVENTION

The present invention relates generally to safety cages for ladders. More particularly, the invention relates to a slideably retractable safety cage enclosure that can be mounted either to the ladder itself or a wall, and can provide a safety enclosure around the top of the ladder to prevent passersby from falling in near the opening.

Fixed ladders find wide utility throughout industry, generally in permanent installations where periodic access to a different level is required for the purposes of maintenance, equipment operation, equipment inspection, or the like. Such fixed ladders are most often used in situations where sufficient lateral space is not available to enable the use of more conventional stairways, or where the frequency or type of use does not economically dictate employment of these more conventional stairways. Fixed ladders find particular applicability when mounted on the side of manholes or other vertical tunnels; to the exterior or interior of fluid containing tanks; or to the exterior or interior of buildings, towers, or other set structures. Manhole ladders that are permanently fixed to the inside wall of a manhole are typically wholly located within the manhole below its upper rim so that the manhole entrance can be covered with a manhole plate or grate. The fact that the ladder does not extend above the manhole entrance makes it difficult for a user to mount and dismount the top end of the ladder. Therefore, the manhole user must support and balance himself from the rim of the manhole during entry until his body is almost entirely within the manhole. Only then can the user grasp the top rung of the manhole ladder. This safety problem occurs upon exiting the manhole as well. This entry and exit situation is dangerous since users can slip and fall during these maneuvers. This danger is augmented in normal operation when the user must carry tools, equipment, and the like into and out of the manhole.

A further complication of these types of fixed ladders is that when the manhole opening is uncovered for use of the ladder, the opening itself presents a danger to anyone in the vicinity. In particular, the result of the typical manhole design is that when the cover is open, the hole is completely exposed and presents a fall hazard for passersby. For safety purposes, users typically must place some sort of warning sign or barricade, or must rope off the opening to alert persons in the vicinity that such fall hazard exists.

Several prior art devices have attempted to solve some of the many problems inherent in manhole design. The majority of the prior art devices have addressed the safety issues related to the ladder user, while failing to address the safety issues related to the manhole opening. In general, some of these devices provide a rail or auxiliary support that is extendable from the ladder so that the ladder user can grasp this extended rail, thus improving his balance and stability while entering and exiting the manhole. These prior art devices, while perhaps assisting the ladder user, have proven to be cumbersome, complicated to use, and time-consuming. In addition, these devices often defeat the purpose of fixed vertical ladders in that the safety devices have fixed, vertically-extending members that, when retracted, occupy an inordinate amount of space near the upper end of the manhole ladder within the manhole. This arrangement impedes user operation and versatility of the manhole. Furthermore, many manholes simply do not have the space required of the extendable supports of the prior art devices. In addition, many entities (for instance, cities, municipalities, industrial work sites, and so forth) own so many manholes that they choose not to purchase prior art safety cages as a result of the extreme costs involved in purchasing a separate safety cage for each and every manhole.

In short, prior art devices have failed to address the needs of both the ladder user and persons in the vicinity of the ladder or manhole opening. In particular, prior art devices do not adequately provide both an extendable safety support for the ladder user and a retractable safety cage that provides an adequate enclosure around the opening to prevent accidental falling into the opening. And, prior art devices have not provided a safety cage that can be completely, but easily, removed from the manhole.

As a result, there is a need for a retractable safety cage device that provides adequate safety support for a user entering and exiting a ladder opening, while at the same time providing a safety enclosure for completely protecting the opening of the manhole, thus providing safety for all persons in the vicinity. There is a further need for such a device that can accomplish these goals while at the same time being mountable on either the ladder itself or the vertical wall, and which does not block or impede the ladder entrance or the space surrounding the top of the ladder. And, there is a need for a safety cage that can be removed from the manhole so that one cage can be employed in numerous manholes that are fitted with the guide bracket.

BRIEF SUMMARY OF THE INVENTION

Accordingly, the present invention is directed to a retractable safety cage device that is mounted on or near the top of a ladder and provides an extendable support for the ladder user, as well as a retractable safety cage to protect the opening near the top of the ladder. The device is mounted either on the ladder or on a structure near the ladder and does not block or impede the space near the top of the ladder in either its extended or retracted position. The invention is usable not only in ladder applications, but also in access holes and access ports that have no ladder therein. An example of such a situation is a subsurface observation port, for instance a maintenance pit observation port, and other ports where, for safety reasons, persons are not allowed inside the pit while the subterranean machinery is in operation. Other pits that find use for the invention are pits containing hazardous materials, drive motors, rotating machinery, and so forth where persons must be able to view the machinery from above the surface of the pit without physically descending into the pit. In such situations, the need exists for a retractable safety cage that, in its extended position, provides a safety enclosure around the opening to prevent persons from falling into the pit. Additionally, the device has the ability to be retractable in a permanent installation or in a removable installation, depending on the needs of the user.

A retractable safety cage for mounting on a wall or a ladder is provided comprising one or more adjustable guide brackets attached to either the wall or the ladder wherein the guide brackets have a portion containing a sleeve through which a rail can slide. At least two main, typically vertical, rails each having a proximal end and a distal end are slideably mounted within the sleeves of the adjustable guide brackets for sliding between a retracted position and an extended position. A locking mechanism is further provided that can releasably lock the retractable safety cage in either the extended or the retracted position. Furthermore, one or more counterbalances are provided that provide a bias force in the direction of the extended position of the retractable safety cage. In addition, a fixed first periphery rail having a first end and a second end each connected to the proximal end of the main rails, is attached to the main rails.

BRIEF DESCRIPTION OF THE DRAWINGS

The teachings of the present invention can be readily understood by considering the following detailed description of the preferred embodiment in conjunction with the accompanying drawings, in which.

DETAILED DESCRIPTION OF THE PREFERRED EMBODIMENT

While the present invention will be described more fully hereinafter with reference to the accompanying drawings, in which particular embodiments and methods are shown, it is to be understood from the outset that persons of ordinary skill in the art may modify the invention herein described while achieving the functions and results of this invention. Accordingly, the descriptions which follow are to be understood as illustrative and exemplary of specific embodiments within the broad scope of the present invention and not as limiting the scope of the invention.

Figure 1:
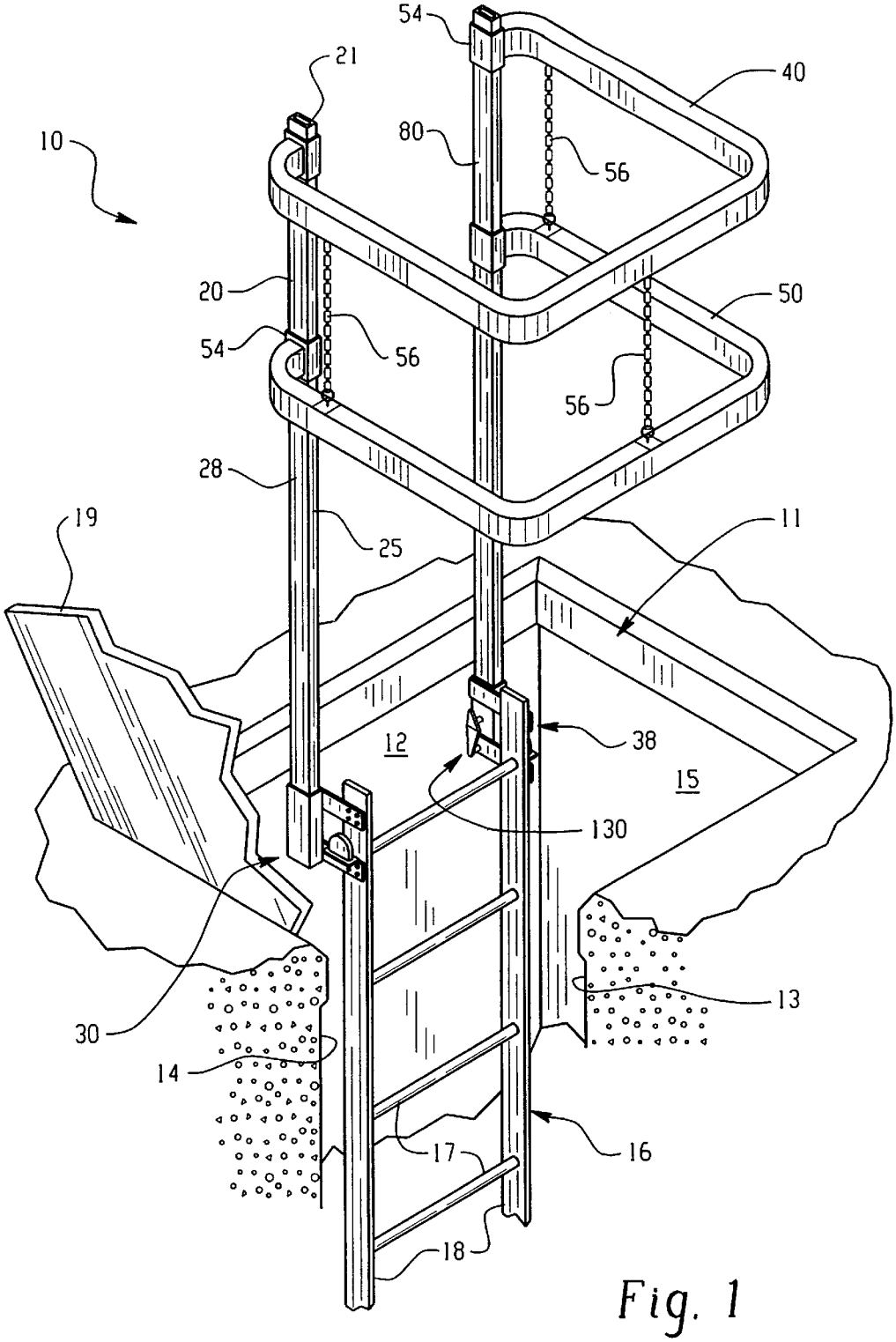
FIG. 1 is a perspective view of a rectactable safety cage in the extended position, according to an embodiment of the invention.

FIG. 1 depicts a typical installation of a retractable safety cage 10 of the present invention. Although the invention is useable in many applications and for many different types of ladders, the common manhole application is depicted in the drawings for ease of discussion. In the typical scenario, a manhole 11 comprises a front face 12, a rear face 13, and at least two side faces, 14, 15. Typically, a manhole ladder 16 is attached in some means to the front face 12 of the manhole 11. The manhole ladder 16 further comprises a plurality of rungs 17, which are typically horizontally disposed, and at least two rails 18 which are typically substantially vertically disposed. The manhole 11 is usually fitted with a manhole cover 19 that prevents persons from falling into the manhole 11 when the manhole ladder 16 is not in use.

Figure 2:
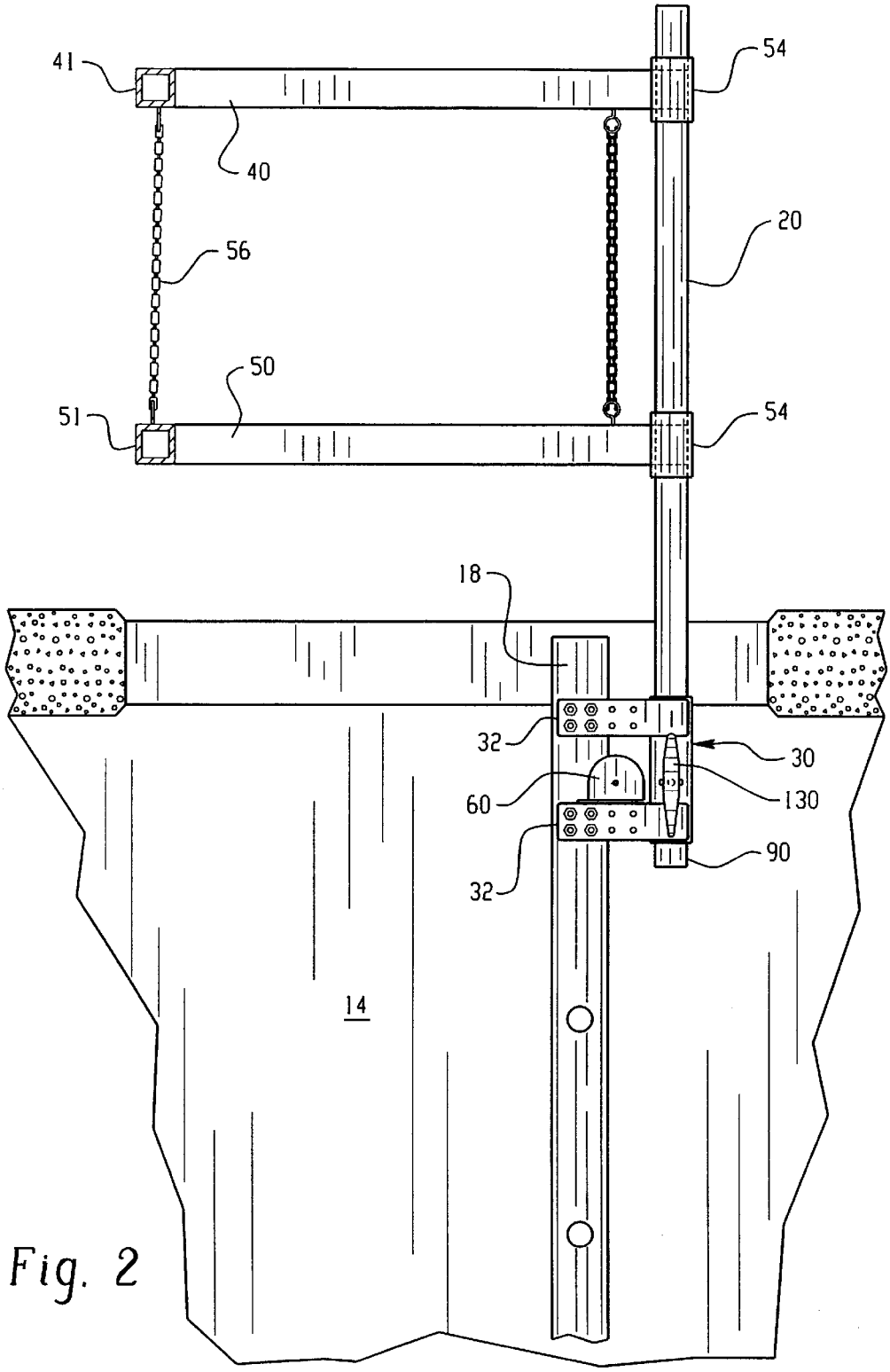
FIG. 2 is a side elevation partial cutaway view of a retractable safety cage in the extended position, according to an embodiment of the invention.
Figure 3:
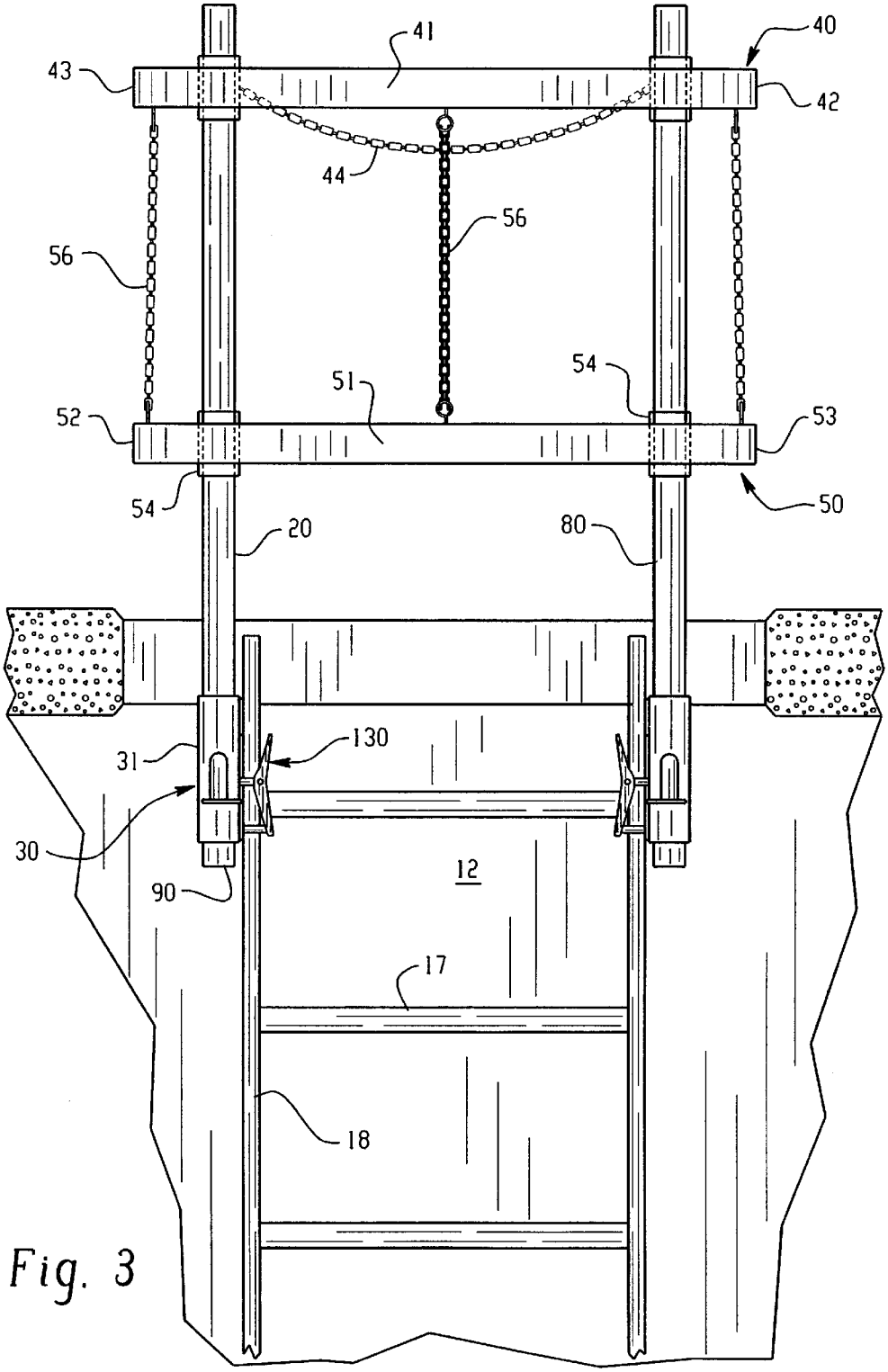
FIG. 3 is a front elevation view of a retractable safety cage in the extended position, according to an embodiment of the invention.

FIGS. 1–4 depict a retractable safety cage 10 according to a preferred embodiment of the present invention. In FIGS. 1, 2, and 3, the safety cage 10 is shown in its extended position, and comprises slideable or extendable main rails 20, 80 that are slideably received in guide brackets 30, 38. Guide brackets 30, 38 are connected, depending upon the design of the manhole 11, either to the manhole ladder 16 or the front face 12 within the manhole 11. In the preferred embodiment, main rails 20, 80 are substantially identical, one being a left main rail 20 and one being a right main rail 80, both of which are substantially vertically disposed. As a result, for the sake of brevity, only one main rail 20 will be further described herein, it being understood that similar structural elements are present on both main rails. Similarly, guide bracket 30 and 38 of the preferred embodiment are substantially identical in structure, with the exception of one being designed for the left main rail 20 and one being designed for the right main rail 80. As a result, for the sake of brevity, only guide bracket 30 will be further described, it being understood that guide bracket 38 comprises similar structure.

Referring to the Figures it can be seen that main rail 20 has a proximal end 21 and a distal end 22. The distal end 22 of the main rail 20 preferably has an opening 24 for receiving a retaining pin 160 (to be described below) when the retractable safety cage 10 is in its extended position. Similarly, the proximal end 21 of the main rail 20 may optionally have an opening 23 for receiving the retaining pin 160 when the retractable safety cage 10 is in its retracted position. The main rail 20 further comprises a first side 25, a second side 26 opposite said first side 25, a third side 27, and a fourth side 28 opposite said third side 27 all of which define an interior space 29 within the main rail 20. In the preferred embodiment, the third side 27 of the main rail 20 near the distal end 22 is swaged or bent inward toward the interior space 29, best shown in FIG. 9. This creates a sort of ramping effect that guides the retaining pin 160 into the opening 24. Many materials are suitable for the main rail 20 including, but not limited to pipe, square tube, rectangular tube, angle iron, or flat iron, all of which can be made from various materials such as stainless steels, mild carbon steels, high tensile strength steels, non-sparking metals, aluminum, titanium, high strength plastic, and basically any other materials capable of withstanding the loads applied. In the preferred embodiment, the main rail 20 is made from standard 1×2 inch thin walled (14 gauge) carbon steel tubing in any length. Typical lengths, however, are approximately 30 to 70 inches, depending upon the application. The main rail 20 obviously must be long enough so that when the retractable safety cage 10 is in its fully extended position, the retractable safety cage 10 is located at the desired height above the surface. Therefore, the greater the desired height above the surface, the longer the main rail 20. In the preferred embodiment, the main rail 20 is approximately 55 inches long.

Referring to FIGS. 1–3, and 6, a guide bracket 30 having a proximal end 350 and a distal end 351 is mounted either to the top portion of ladder rails 18 or to the front face 12 of the manhole 11. Guide bracket 30 preferably comprises a slide housing 31 attached to one or more guide bracket extensions 32. The slide housing 31 is a tubular or other generalized cylindrical or body having a first side 310, a second side 311 opposite said first side 310, a third side 312 and a fourth side 313 opposite said third side 312, all of which define an interior space 314 extending through the slide housing 31. The third side 312 further comprises at least one opening 35 therethrough that receives a retaining pin 160. The opening 35 aligns with the opening 24 in the distal end 22 of the main rail 20 when the retractable safety cage 10 is in its extended position. Similarly, the opening 35 in the slide housing 31 aligns with the opening 23 in the proximal end 21 of the main rail 20 when the retractable safety cage 10 is in its retracted position.

Figure 6A:
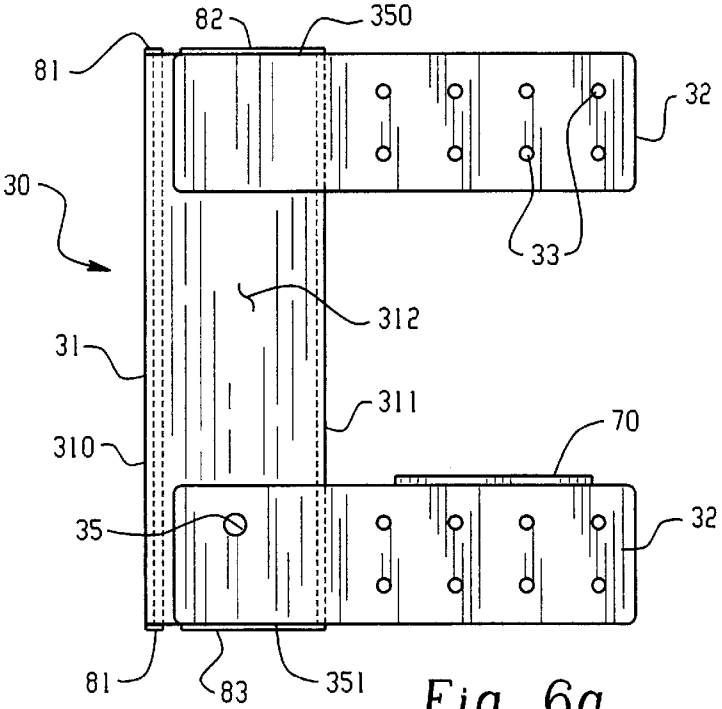
FIG. 6*a* is a side elevation view of a guide bracket according to an embodiment of the invention.
Figure 6B:
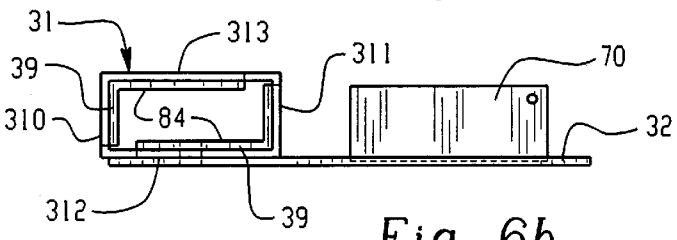
FIG. 6*b* is a top plan view of the guide bracket of FIG. 6*a;*
Figure 7B:
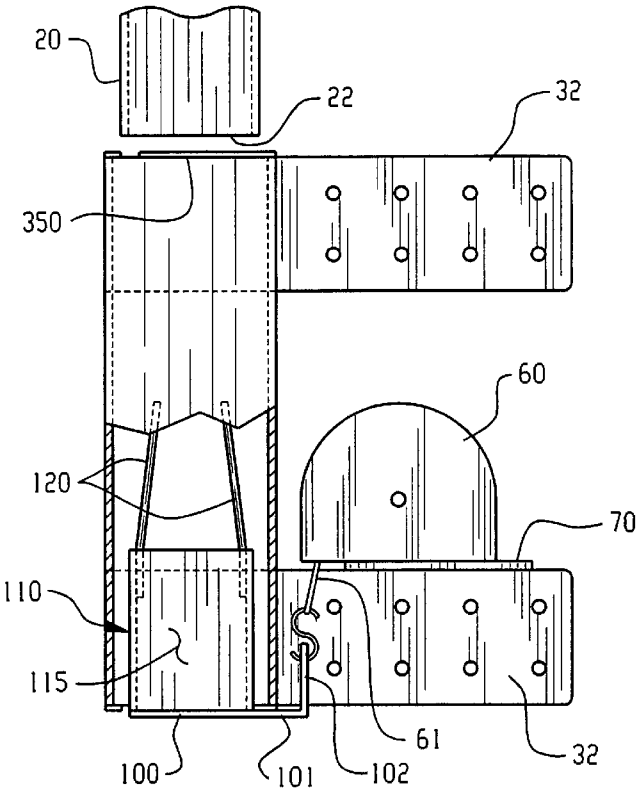
FIG. 7*b* is a partial cutaway side elevation view of the guide bracket of FIG. 7*a;*
Figure 7A:
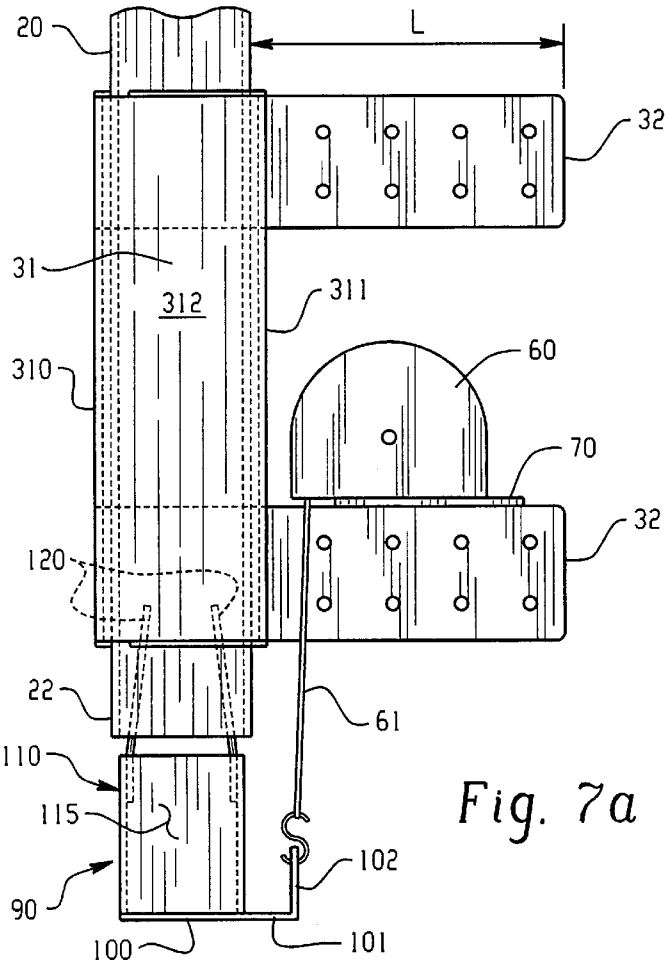
FIG. 7*a* is a side elevation view of a guide bracket and coupling foot assembly according to an embodiment of the invention.

Referring to FIGS. 6 and 7, guide bracket extensions 32 are preferably elongated plate-like members. In the preferred embodiment, guide bracket extension 32 further comprises a mounting plate 70 for receiving a counterbalance 60, as shown in FIG. 7. The guide bracket extension 32 has a length, L, that provides adjustability in the mounting location. The guide bracket extension 32 optionally can have a plurality of openings 33 therethrough at spaced-apart intervals. These openings 33 receive fasteners that connect the guide bracket 30 to the ladder rail 18 (or, alternatively, to the front face 12). The length L, and optionally the plurality of openings 33, allows adjustability in the positioning of guide bracket 30, and therefore positioning of the retractable safety cage 10 (as will be more fully described below).

In use, the slide housing 31 slideably receives the main rail 20 so that main rail 20 is slideable from a retracted position (wherein the proximal end 21 of the main rail 20 is located near the top of the manhole ladder 16 and below the manhole cover 19), and an extended position (wherein the distal end 22 of the main rail 20 is located near the top of the manhole ladder 16 and the proximal end 21 of the main rail 20 extends above the manhole cover 19).

Figure 8A:
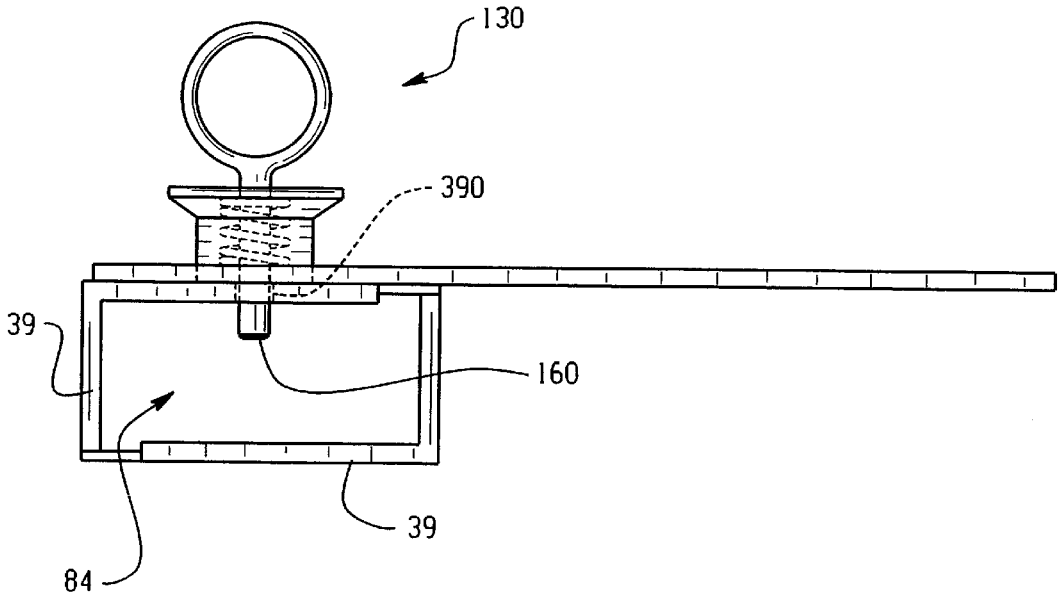
FIG. 8*a* is a top plan view of an alternative embodiment of the guide bracket according to the invention.
Figure 8B:
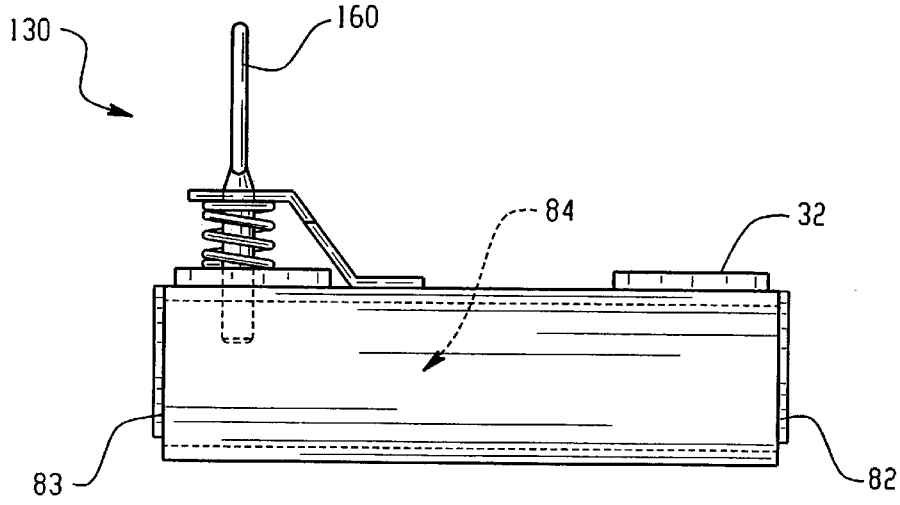
FIG. 8*b* is a side elevation view of the guide bracket of FIG. 8*a;*

Preferably, slide housing 31 is a tubular member that contains therein a bushing 39 made from a variety of materials such as polymers, composites, ceramics, or glasses, or other material with low coefficient of friction to facilitate movement of the main rail 20 within the slide housing 31. Sample materials that could be used include, but are not limited to, the following: linear polymers such as polyethylene, polypropylene, polytetrafluoroethylene, polystyrene, polyvinylchloride, polymethylmethacrylate and nylon; cross-linked polymers including polyesters and formaldehyde-based plastics; and composites of carbon, cellulose, and glass; to name but a few. The preferred material is nylon. In the preferred embodiment, bushing 39 comprises two substantially L-shaped longitudinal nylon members having an external lip 81 at both its proximal end 82 and its distal end 83, as shown in FIG. 8. Bushings 39 are designed such that their length between each external lip 81 corresponds to the length of the slide housing 31. The external lip 81 on the proximal end 82 and distal end 83 retains the bushings 39 within the slide housing 31. Because the preferred bushings 39 are substantially L-shaped, when they are fitted within the slide housing 31 they provide a substantially rectangular inner surface 84 through which the main rail 20 slides, as best shown in FIGS. 6, 7 and 8. The opening 35 in the slide housing 31 is collinear with an opening 390 in the bushing 39 to allow the retaining pin 160 to protrude through both the slide housing 31 and the bushing 39 when the retaining pin 160 is engaged.

In the most preferred embodiment, the retractable safety cage 10 is not only slideably retractable, but is also easily removable from the manhole 11. This is achieved by additional structure coupled to the distal end 22 of the main rail 20, as will now be described. In this preferred embodiment shown in FIGS. 7 and 9, the guide bracket 30 further comprises a foot 90 comprising a stop 100, a rail extension 110, and at least one longitudinally extending tab 120. The foot 90 serves to couple the retractable safety cage 10 to the guide bracket 30 so that the cage 10 can be completely removed from the guide bracket 30. This results in the foot 90 and the main rail 20 sliding as one unit with little or no relative movement therebetween. Embodiments that are retractable but not completely removable comprise a guide bracket 30 that does not contain foot 90, such as the guide bracket 30 shown in FIG. 6.

The rail extension 110 is preferably made from the same material as that of the main rail 20. The rail extension 110 has a proximal end 111 and a distal end 112, and a first side 113, a second opposite side 114, a third side 115, and a fourth side 116 which, together, define an inner surface 117. The distal end 112 of the rail extension 110 is fixedly attached to the stop 100, preferably by welding or similar technique. The stop 100 further comprises a protrusion 101 extending a predetermined distance away from the second side 114 of the rail extension 110, and a portion 102 that extends longitudinally toward the proximal end 111 of the rail extension 110. A through-hole 103 is located in the portion 102 and receives a hook that is connected to a strap 61 of a counterbalance 60 (to be described below). The proximal end 111 of the rail extension 110 is preferably open in order to receive the tab 120. The tab 120 is fixedly attached to the inner surface 117 of the rail extension 110 and extends longitudinally outwardly from the proximal end 111 of the rail extension 110. The tab 120 is insertable into the interior space 29 of the distal end 22 of the main rail 20. The distance that the tab 120 extends outwardly from the distal end 112 of the rail extension 110 is variable, but should at least be great enough so as to create a secure coupling when the distal end 22 of the main rail 20 is fitted onto the tab 120. This minimum distance is approximately 2 inches. In the preferred embodiment, this distance is approximately 3 inches. However, it may be beneficial to manufacture the tab 120 so that it protrudes outwardly from the proximal end 350 of the guide bracket 30. In the preferred embodiment, this would render the tab 120 approximately 4 inches to 10 inches in length, depending on the length of the slide housing 31 and the rail extension 110. In this situation, the tab 120 provides a convenient and effective guide for an operator to manually place the main rail 20 of a removable retractable safety cage 10 onto the foot 90, thereby slideably and removably attaching the cage 10 to the guide bracket 30. It should be noted that an equivalent means of coupling the foot 90 to the main rail 20 could be made by placing the tab 120 at the distal end 22 of the main rail 20, and have the tab 120 removably fit within the inner surface 117 of the rail extension. Any form of male/female fittings known in the art may work.

Figure 10B:
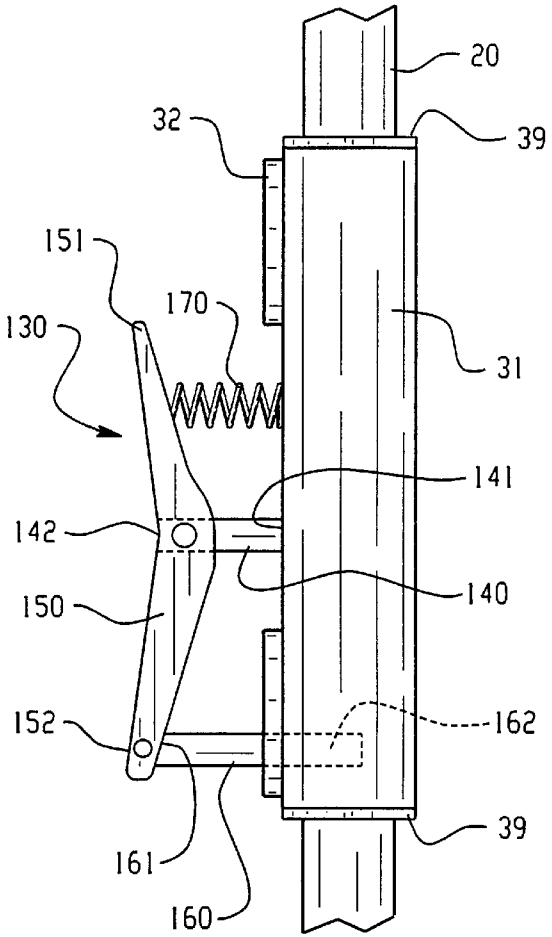
FIG. 10*b* is a front elevation view of the releasable locking mechanism of FIG. 10*a;*
Figure 10A:
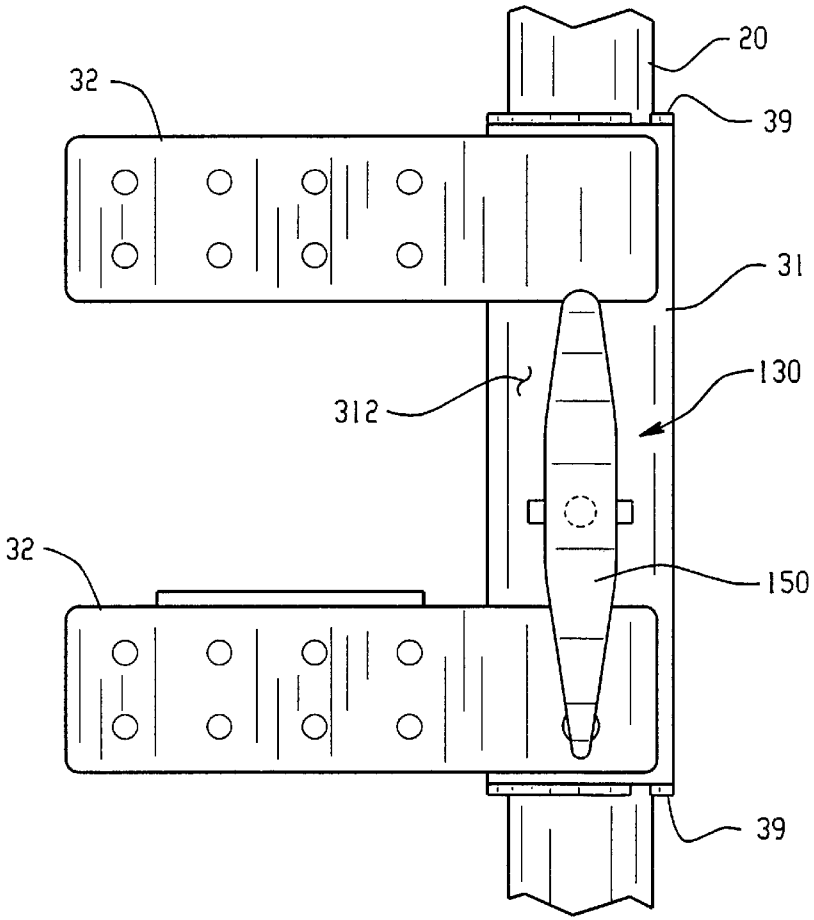
FIG. 10*a* is a side elevation view of the releasable locking mechanism according to preferred embodiment.
Figure 11A:
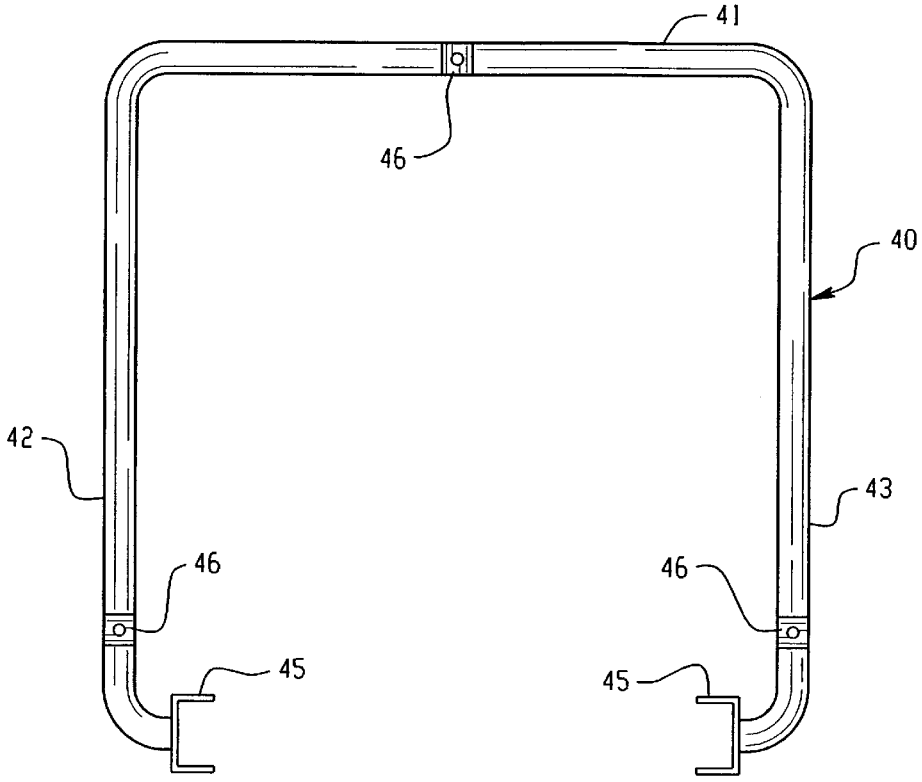
FIG. 11*a* is a top view of a fixed top rail according to an embodiment of the invention.
Figure 11B:
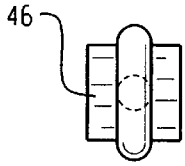
FIG. 11*b* is a top view of a support plate of the fixed top rail of FIG. 11*a;*
Figure 11C:
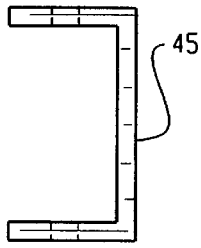
FIG. 11*c* is a top view of a mounting bracket according to an embodiment of the invention.
Figure 11D:
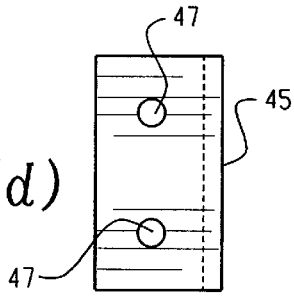
FIG. 11*d* is a front elevation view of the mounting bracket of FIG. 11*c;*
Figure 14:
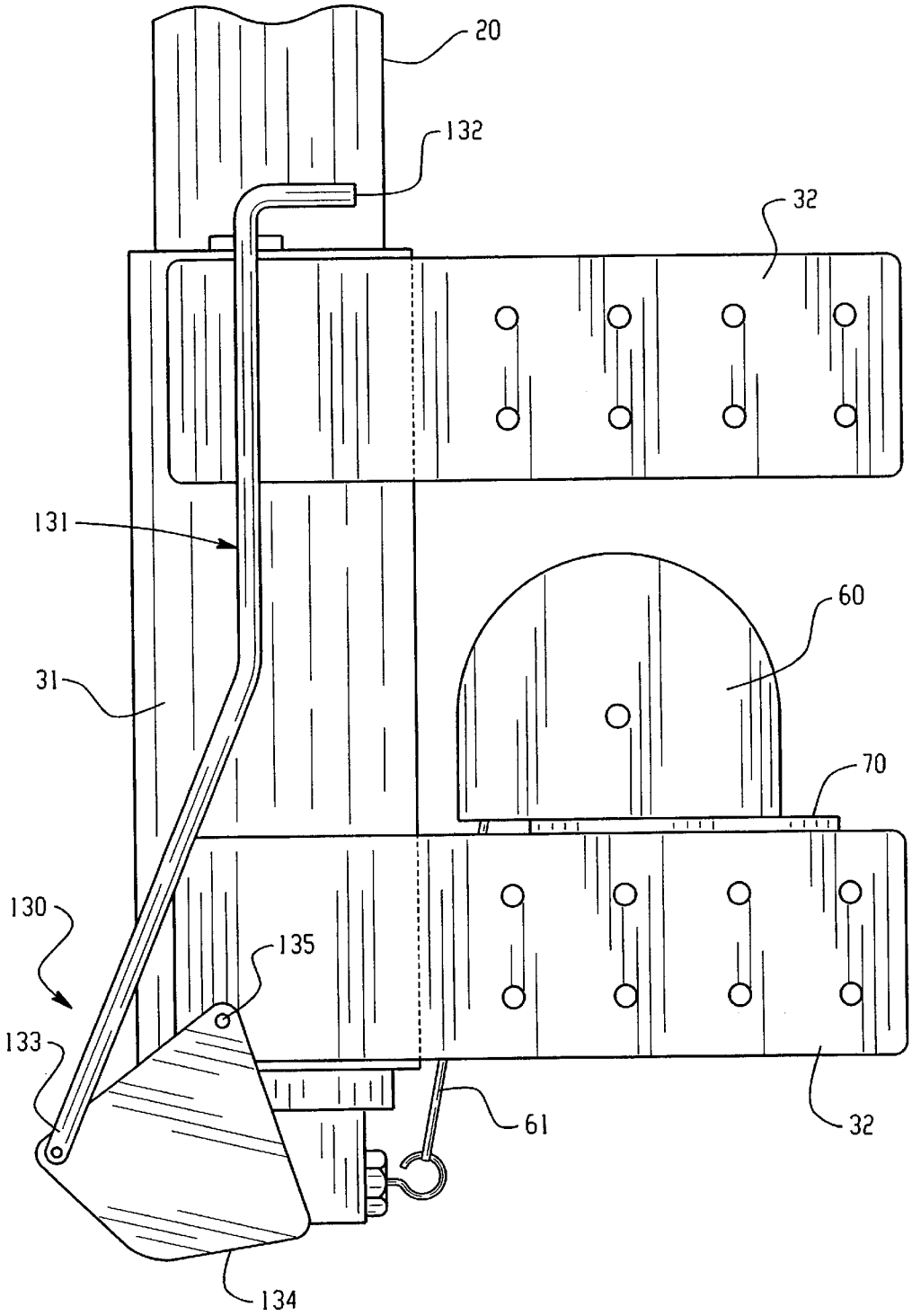
FIG. 14 is a side elevation view of the adjustable guide bracket and releasable locking mechanism according to an alternative embodiment of the invention.

A releasable locking mechanism 130 is mounted on the third side 312 of the slide housing 31, preferably toward the distal end 351 thereof. Obviously many designs for the releasable locking mechanism 130 are possible, it being the goal of providing a releasable latch mechanism that can engage and disengage the main rail 20. To name but a few examples, cotter pins, keys, spring pins, sliding latches, pins with ball detents, and many other common forms of latches could be used. Indeed, FIG. 14 depicts an alternative embodiment of the retaining pin assembly 130 comprising a lever 131 having a proximal end 132 and a distal end 133. The distal end 133 is pivotally connected to a retaining arm 134 having a substantially trapezoidal shape. The retaining arm 134 is pivotally connected to the guide bracket 30 at pivot 135. When a user desires to retract the retractable safety cage 10, he simply pulls the distal end 132 of the lever 131, thereby making retaining arm 134 pivot about pivot 135 and removing the portion of retaining arm 134 that blocks the distal end 352 of the slide housing 31. This allows the main rail 20 to move from its extended position to its retracted position. Referring to FIG. 10, the releasable locking mechanism 130 of the preferred embodiment is shown, and further comprises a fulcrum 140, a lever 150, a retaining pin 160, and a spring 170. The fulcrum 140 comprises a base 141 that is fixed, preferably welded, to the guide bracket 30, and a free end 142 that extends in a radial direction outwardly from the guide bracket 30. The lever 150 is pivotally attached to the free end 142 of the fulcrum 140, and further comprises a handle portion 151 disposed opposite a pin portion 152. The retaining pin 160 has a fixed end 161 and, an engaging end 162. The pin portion 152 of the lever 150 is fixed to the fixed end 161 of the retaining pin 160. The spring 170 is mounted on the slide housing 31 beneath the handle portion 151 of the lever 150 so as to provide a spring bias force in a direction that tends to force the engaging end 162 of the retaining pin 160 farther into the interior space 29 of the main rail 20.

Figure 4:
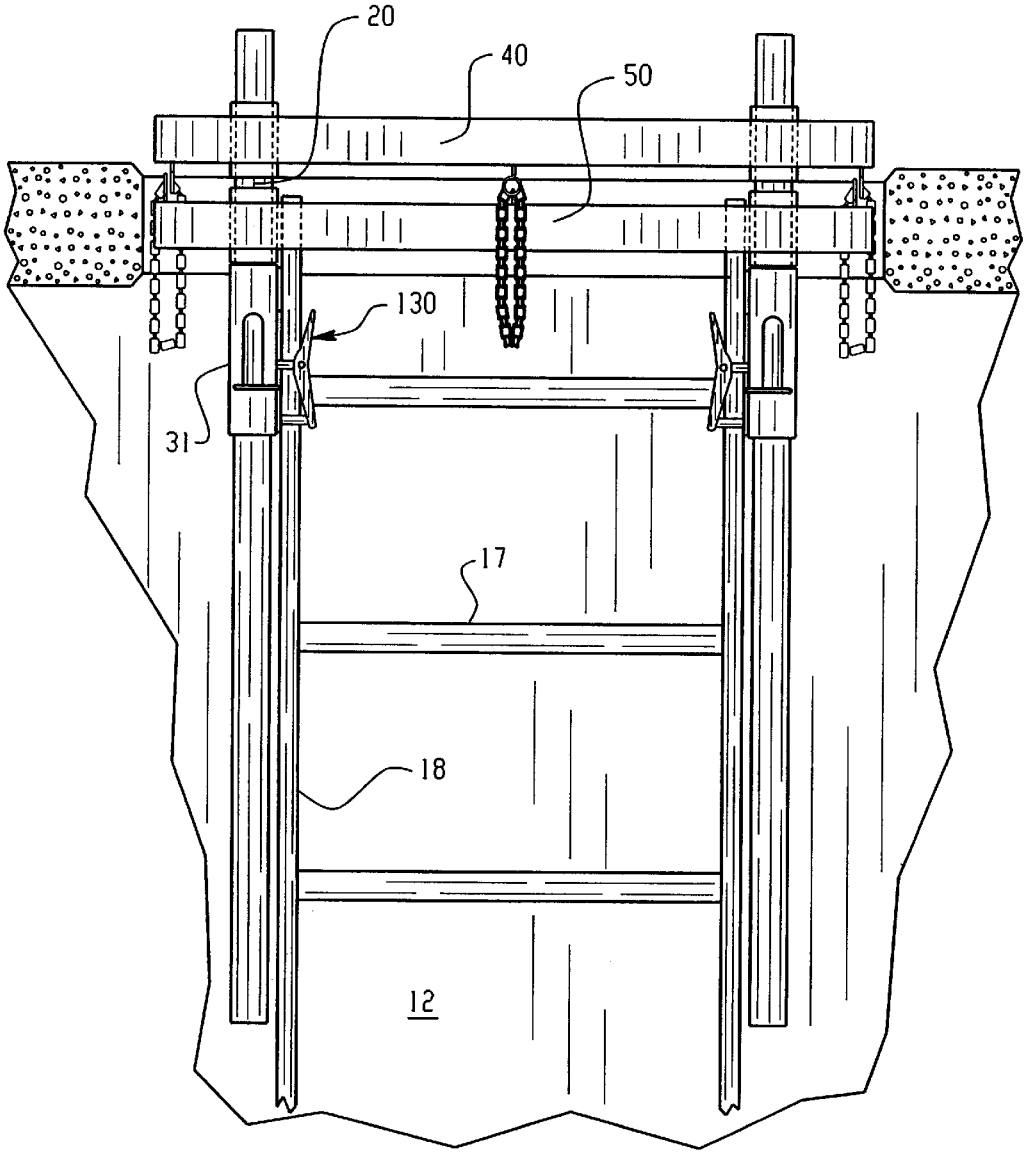
FIG. 4 is a front elevation view of a retractable safety cage in the retracted position, according to an embodiment of the invention.

As a result, the retaining pin 160 may be inserted through the opening 35 in the slide housing 31 and through the opening 24 in the distal end 22 of the main rail 20 when the retractable safety cage 10 is in its extended position, thus locking the retractable safety cage 10 in its extended position (FIG. 2). Likewise, the retaining pin 160 may be inserted through the opening 35 in the slide housing 31 as well as through the opening 23 in the proximal end 21 of the main rail 20 when the retractable safety cage 10 is in its retracted position, thus locking the retractable safety cage 10 in its retracted position (FIG. 4). The materials that are suitable for the main rail 20 are also suitable for the guide bracket 30. In the preferred embodiment, the slide housing 31 is made from standard 1½×2½ inch thin-walled (14 gauge) steel tubing approximately 7½ inches in length. Attached thereto are the guide bracket extensions 32 that are made from ¼×2×7¼ inch plate steel.

Figure 12A:
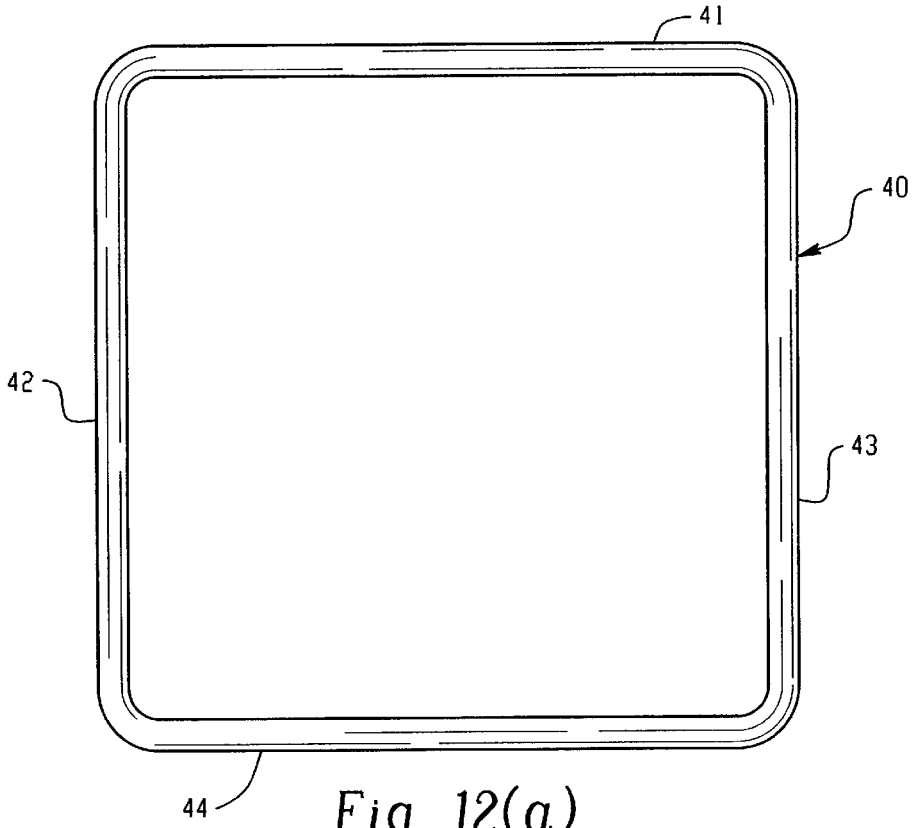
FIG. 12*a* is a top plan view of a retractable safety cage according to an alternative embodiment wherein front portion is a solid rigidly attached member.
Figure 12B:
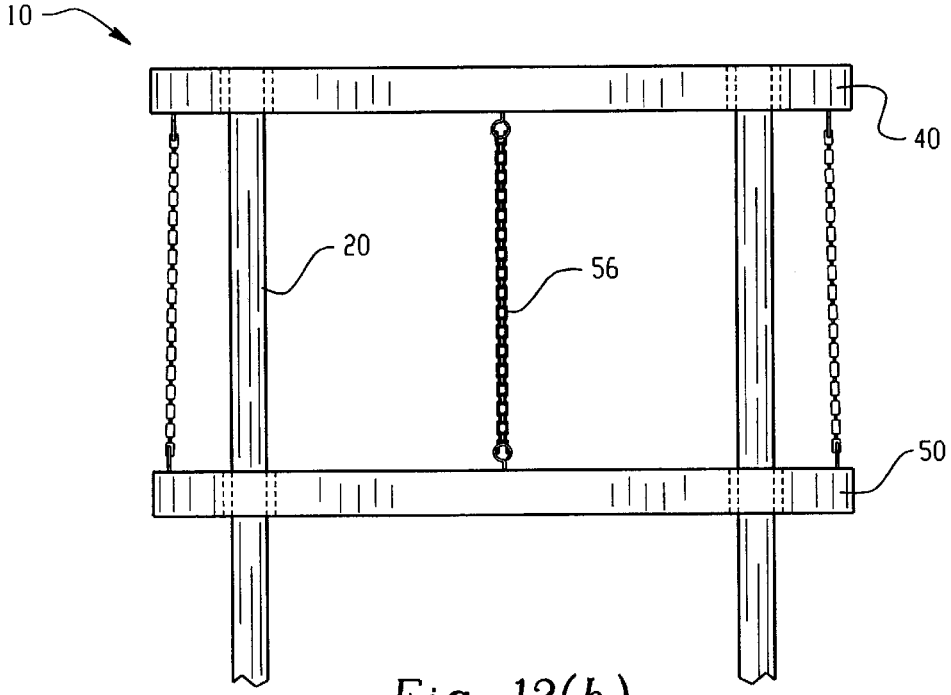
FIG. 12*b* is a front elevation view of the retractable safety cage of FIG. 12*a;*
Figure 13A:
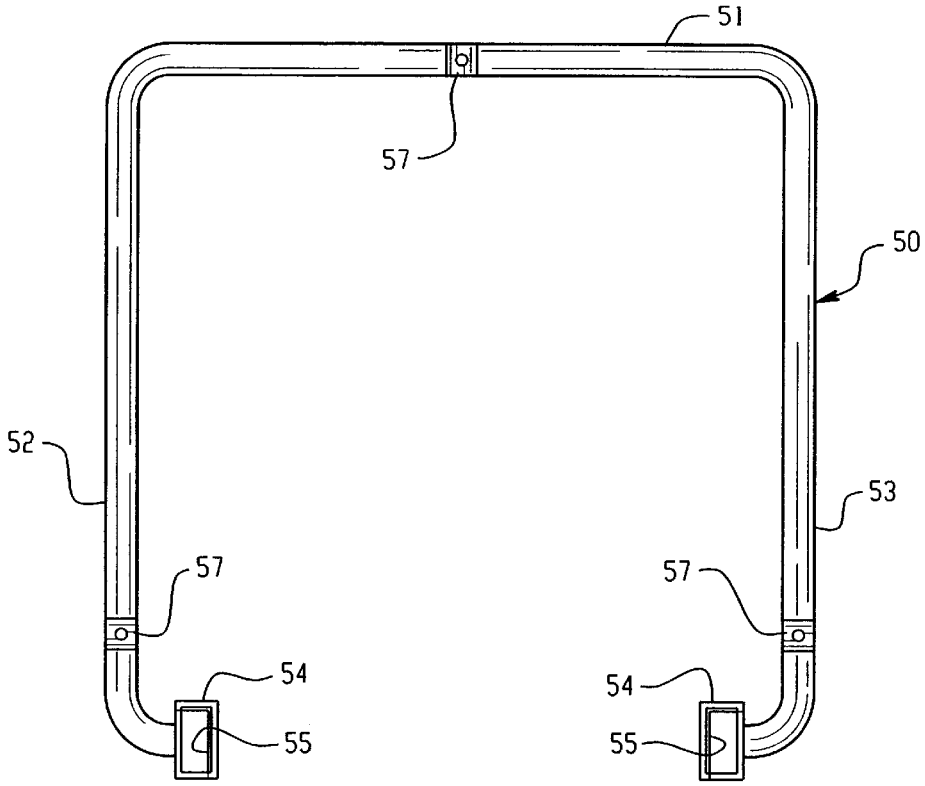
FIG. 13*a* is a top plan view of a floating periphery rail according to an embodiment of the invention.
Figure 13B:
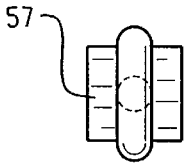
FIG. 13*b* is a top view of a support plate of the fixed top rail of FIG. 13*a;*
Figure 13C:
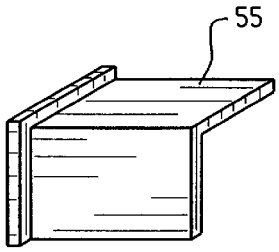
FIG. 13*c* is a is a perspective view of a bushing for the floating rail of FIG. 13*a;*
Figure 13D:
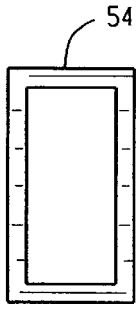
FIG. 13*d* is a top view of a collar for the periphery rail of FIG. 13*a;*

Referring now to FIGS. 1 and 11, a first periphery rail 40 is affixed to the proximal end 21 of the main rail 20, and is preferably horizontally disposed. The method of fixation can be any of a number of methods suitable for the materials employed in the retractable safety cage 10, including, but not limited to, welding, bolting, other threaded connections, geometric connections (that is, containing mating male and female geometric shapes) and so forth. FIG. 11 depicts a mounting bracket 45 that is welded to the first periphery rail 40 and comprises openings 47 therethrough for bolting the first periphery rail 40 to the main rail 20. First periphery rail 40 preferably comprises at least a back portion 41 and two side portions 42, 43, thus creating a peripheral enclosure having at least three sides (that is, enclosing approximately 270° of the opening). The side portions 42, 43 are spaced apart preferably at least 23 inches to accommodate stretchers and other devices that often need to be placed in the manhole 11. Because standard manhole ladders 16 are typically only 18 inches wide, it can be seen that the first periphery rail 40 creates a perimeter that is larger than typical prior art ladder extensions that merely extend the ladder rails 18. The preferred three-sided periphery provides not only support for the ladder user for entering and exiting the manhole 11, but also provides a peripheral safety cage that substantially surrounds the opening of the manhole 11, thus providing a safety barrier therearound. An optional front portion 44 can also be employed to provide a four-sided, or approximately 360° enclosure. However, when the optional front portion 44 is employed, some means of opening and closing the front portion 44 must be utilized if the retractable safety cage is used for a manhole 11 having a ladder 16. Examples of such opening and closing means could include hinged connections, slideable connections, retractable connections, or removable pieces that must be removed and separately stored. The preferred embodiment does not utilize the optional front portion 44. FIG. 3 shows a retractable safety cage 10 wherein front portion 44 is a chain. FIG. 12 shows a retractable safety cage 10 wherein front portion 44 is a solid, rigidly attached member for applications requiring only visual access to subterranean areas.

The retractable safety cage 10 is designed such that when it is in its extended position, the first periphery rail 40 is situated above the surface of the ground in the typical manhole application at heights that are approved by local, state, or federal safety regulations (such as OSHA). In the preferred embodiment, when the retractable safety cage 10 is in its extended position, the first periphery rail 40 is situated approximately 39 to 42 inches above the surface. Basically, the same materials that are suitable for the main rail 20 are also suitable for the first periphery rail 40. Anticipated applied loads include the dead weight of the cage 10 plus the weight of a ladder user suspending himself from the first periphery rail 40. In the preferred embodiment, the first periphery rail is made from standard 1×2 inch thin-walled (14 gauge) steel tubing. This material provides both a good welding material as well as a material that is suitable for bolted connections.

Referring now to FIGS. 1 and 13, at least one floating periphery rail 50 is slideably received on the main rail 20. The floating periphery rail 50 preferably has the same shape as the first periphery rail 40. Namely, floating periphery rail 50 preferably comprises a back portion 51 and at least two side portions 52, 53. It should be stated at this point, however, that the actual geometric shape of the first periphery rail 40 and the floating periphery rail 50 is a matter of design choice dependent in part on the shape of the manhole 11, it being more important that the shape provide a perimeter enclosure about substantially all sides (for example, at least approximately 270°) of the manhole 11 opening, and yet still provides sufficient space for inserting things into the manhole 11. In other words, the first periphery rail 40 and the floating periphery rail(s) 50 may take a substantially circular shape or any substantially polygonal shape, to state but a few examples. The floating periphery rail 50 has a collar 54 that slideably receives the main rail 20. As with the slide housing 31, the collar 54 preferably has a bushing 55, of similar material as that of bushing 39 that facilitates slideable movement along a length of the main rail 20. The preferred bushing 55 is made of nylon.

Basically, the same materials that are suitable for the first periphery rail 40 are also suitable for the first periphery rail 50. Anticipated applied loads include the dead weight of the cage 10 plus the weight of a ladder user suspending himself from the first periphery rail 50. In the preferred embodiment, the first periphery rail is made from standard 1×2 inch thin-walled (14 gauge) steel tubing. This material provides both a good welding material as well as a material that is suitable for bolted connections.

Referring again to FIGS. 1, 11 and 13, floating periphery rail 50 is connected to the first periphery rail 40 so that when the retractable safety cage 10 is in its extended position, the floating periphery rail 50 slides to a preselected distance from the first periphery rail 40. In the preferred embodiment this is achieved by attaching non-rigid connectors 56 to both the first periphery rail 40 and the floating periphery rail 50. In the preferred embodiment, the connectors 56 comprise chains that are coupled to eye bolts and support plates 46, 57 connected to the first periphery rail 40 and the second periphery rail 50 respectively. As the retractable safety cage 10 is moved from its extended position to its retracted position, the non-rigid connectors 56 allow the floating periphery rail 50 to slide closer to the first periphery rail 40. This arrangement occupies a minimum amount of space and therefore is suited for manholes 11 that have appurtenances or the like near the manhole opening that would prohibit the use of prior art extending devices. In particular, as best shown in FIG. 4, the horizontal disposition of the first periphery rail 40 and the floating periphery rail 50 allows the retractable safety cage 10 to be installed in manholes 11 having very little vertical clearance between the top of the manhole 11 and other structures that may be in the vicinity of the upper regions of the manhole ladder 16. Many other alternative non-rigid connectors 56 are possible, including but not limited to cables, straps, ropes, telescoping members, sliding diagonal members, and so forth. Again, referring to FIG. 4, by using non-rigid connectors 56, when the retractable safety cage 10 is in its fully retracted position, the floating periphery rail 50 rests in close proximity to the underside of the first periphery rail 40. By contrast, referring to FIGS. 1–3, when the retractable safety cage 10 is in its fully extended position, the floating periphery rail 50 drops to a position below the first periphery rail 40, wherein this position is located at a distance below the first periphery rail 40 that is equal to the length of the non-rigid connectors 56 and the eye bolts connected to both the first periphery rail 40 and the floating periphery rail 50.

In an alternative embodiment, floating periphery rail 50 may be rigidly attached to the first periphery rail 40 by using rigid connectors 56 and omitting the collar 54. Because this embodiment requires greater space near the upper region of the manhole ladder 16 this embodiment is not preferred.

Referring again to the Figures, the preferred embodiment of the retractable safety cage 10 further comprises at least one counterbalance 60 that is mounted on the mounting bracket 70 on the guide bracket extension 32 near the distal end 22 of the main rail 20. The counterbalance 60 can be any standard spring, pneumatic, or hydraulic balancing or return mechanism standard in the mechanical industry. In the preferred embodiment, the counterbalance 60 is a spring counterbalance having a pressed steel casing that encloses a type 304 stainless steel tape 61 which is wound on a removable drum. A steel spring holds the tape 61 with uniform tension, and the mechanism is permanently greased inside and zinc coated outside. Depending on the length of travel needed between the extended position and the retracted position, the preferred spring counterbalance 60 is an overhead style, 46 inch tape travel spring counterbalance available from McMaster-Carr Industrial Supply, model number 1053A38, having a capacity of 27 to 29 pounds. For applications requiring greater tape travel, the preferred model is model number 1053A57, having a 54 inch tape travel and rated at 30 to 32 pounds. The counterbalance 60 provides a force on the main rail 20 that slightly biases the rail 20 towards an extended position. Ideally, the amount of bias force on the main rail 20 is sufficient to maintain the dead weight of the safety cage 10 in its extended position, but not great enough to move the retractable safety cage 10 from its extended position to its retracted position without the application of a minimum force applied by the user. This prevents the safety cage 10 from slamming into its retracted position when the retaining pins 160 are disengaged. In addition, this bias force toward the extended position assists the user in moving, that is lifting, the retractable safety cage 10 from its retracted position to its extended position.

Figure 9:
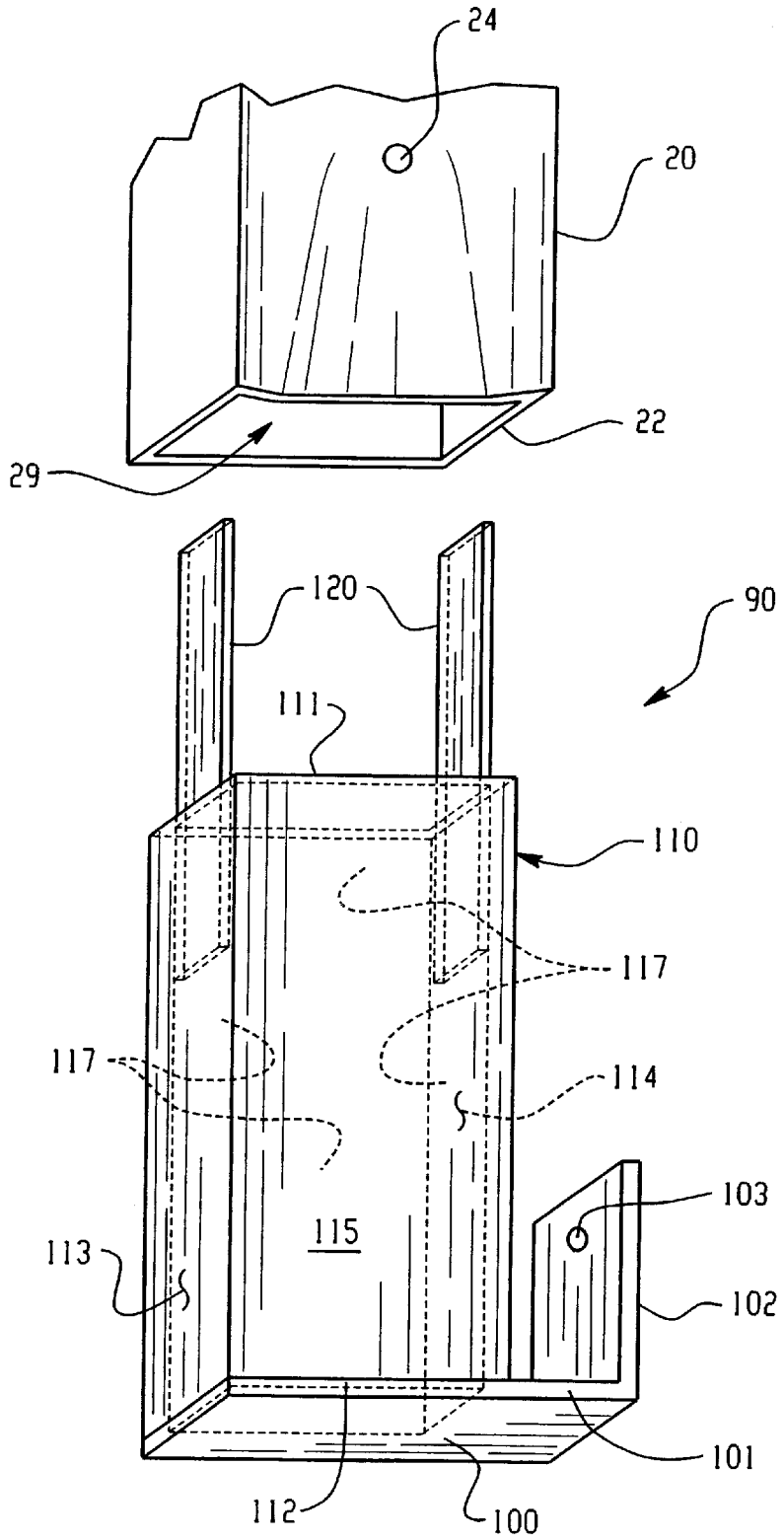
FIG. 9 is a side perspective view of the coupling foot according to the preferred embodiment.

Referring again to the Figures, the method of using the retractable safety cage 10 will now be described. The guide bracket 30 (FIGS. 6 and 7) is mounted to either the two rails 18 of a manhole ladder 16, or alternatively to the front face 12 of the manhole 11. The length L of the guide bracket extension 32 provides the user with adjustability in the mounting location for the retractable safety cage 10. Specifically, the user may position the guide bracket extension 32 vertically and horizontally within the manhole 11 so that the retractable safety cage 10, when extended, maintains a very close clearance near the front face 12 of the manhole 11. In the preferred removable embodiment of the retractable safety cage 10, each guide bracket 30 further comprises a foot 90 (FIGS. 7 and 9). Each counterbalance 60 is mounted to the mounting bracket 70 on the guide bracket extension 32, and the strap 61 of the counterbalance 60 is connected to the through-hole 103 in the stop 100, preferably with an S hook. Typically, one guide bracket 30 and counterbalance 60 assembly is required for each rail 18 of the manhole ladder 16.

Figure 5B:
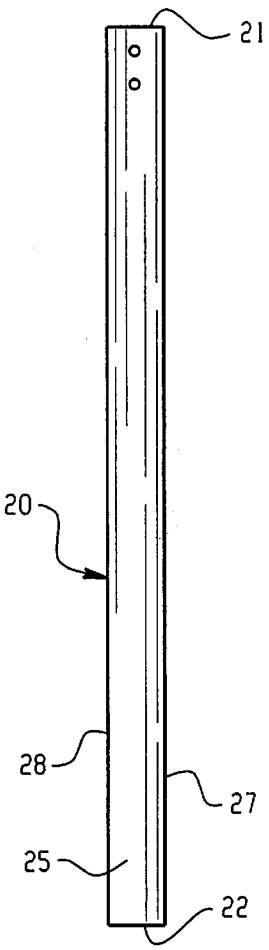
FIG. 5*b* is a front elevation of the main rail of FIG. 5*a;*
Figure 5A:
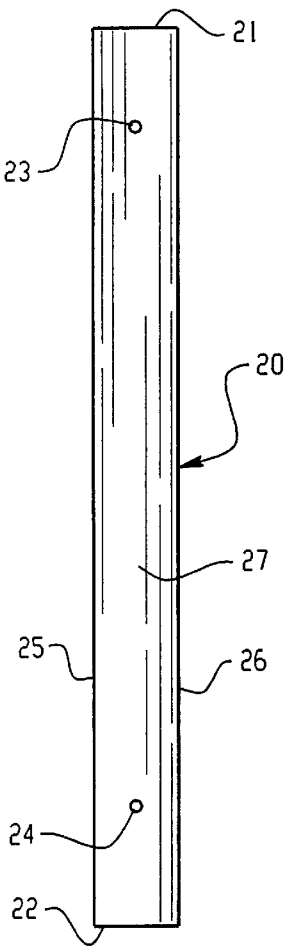
FIG. 5*a* is a side elevation view of a main rail according to an embodiment of the present invention.

Now, the guide brackets 30 are ready to receive the remaining structure of the retractable safety cage 10, comprising main rails 20 that are connected to a first periphery rail 40 and a floating periphery rail 50 (FIGS. 1, 11, 13). The user can then simply open the manhole cover 19 and insert the distal end 22 of each main rail 20 into the inner surface 84 within the bushing 39. As the main rails 20 are slid downwardly within the inner surface 84, the retaining pin 160 will engage the opening 24 in the distal end 22 of the main rail 20. This then places the retractable safety cage 10 into its extended position. When the user desires to retract the retractable safety cage 10, he simply depresses the handle portion 151 of the lever 150, thereby moving retaining pin 160 from its engaged position to its disengaged position (FIG. 10). This then allows the retractable safety cage 10 to slide from its extended position to its retracted position. Once the retractable safety cage 10 moves into its retracted position, the retaining pin 160 will, under the spring bias force, move from its disengaged position to its engaged position in the opening 23 that is located near the proximal end 21 of the main rail 20 (FIG. 5). This then releasably locks the retractable safety cage in its retracted position, wherein the entirety of the retractable safety cage 10 resides below the surface of the manhole cover 19 (FIG. 4). When the user desires to again extend the retractable safety cage 10 he simply disengages the retaining pin 160 in a similar fashion, and manually lifts the main rail 20 until the retaining pin 160 engages opening 24 in the distal end 22 of the main rail 20. If the user then desires to completely remove the removable safety cage 10, he simply again disengages the. retaining pin 160 from opening 24, and further raises the main rails 20 until stop 100 engages the distal end of the guide bracket 30 (or, the external lip 81 of the bushing 39). Once this occurs, further lifting of the main rails will separate the distal end 22 from the coupling engagement with the tab 120 of foot 90 (FIGS. 7 and 9). This allows the user to then take the assembly of main rail 20, first periphery rail 40, and floating periphery rail 50 and insert it into any manhole 11 that has been fitted with this type of guide bracket 30.

Figure 15:
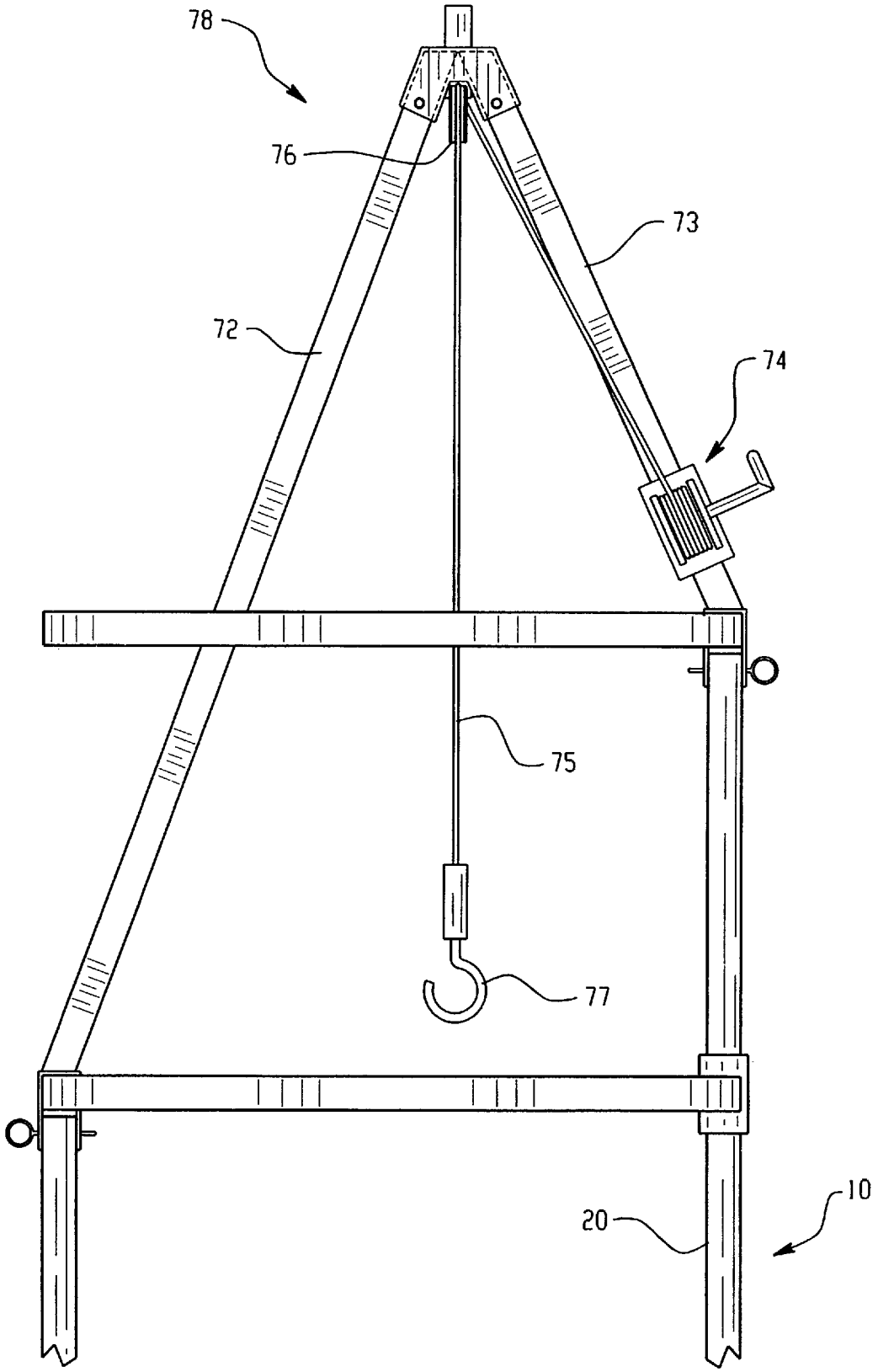
FIG. 15 is a side elevation view of an optional emergency egress frame for mounting on the retractable safety cage according to an alternative embodiment of the invention.
Figure 16:
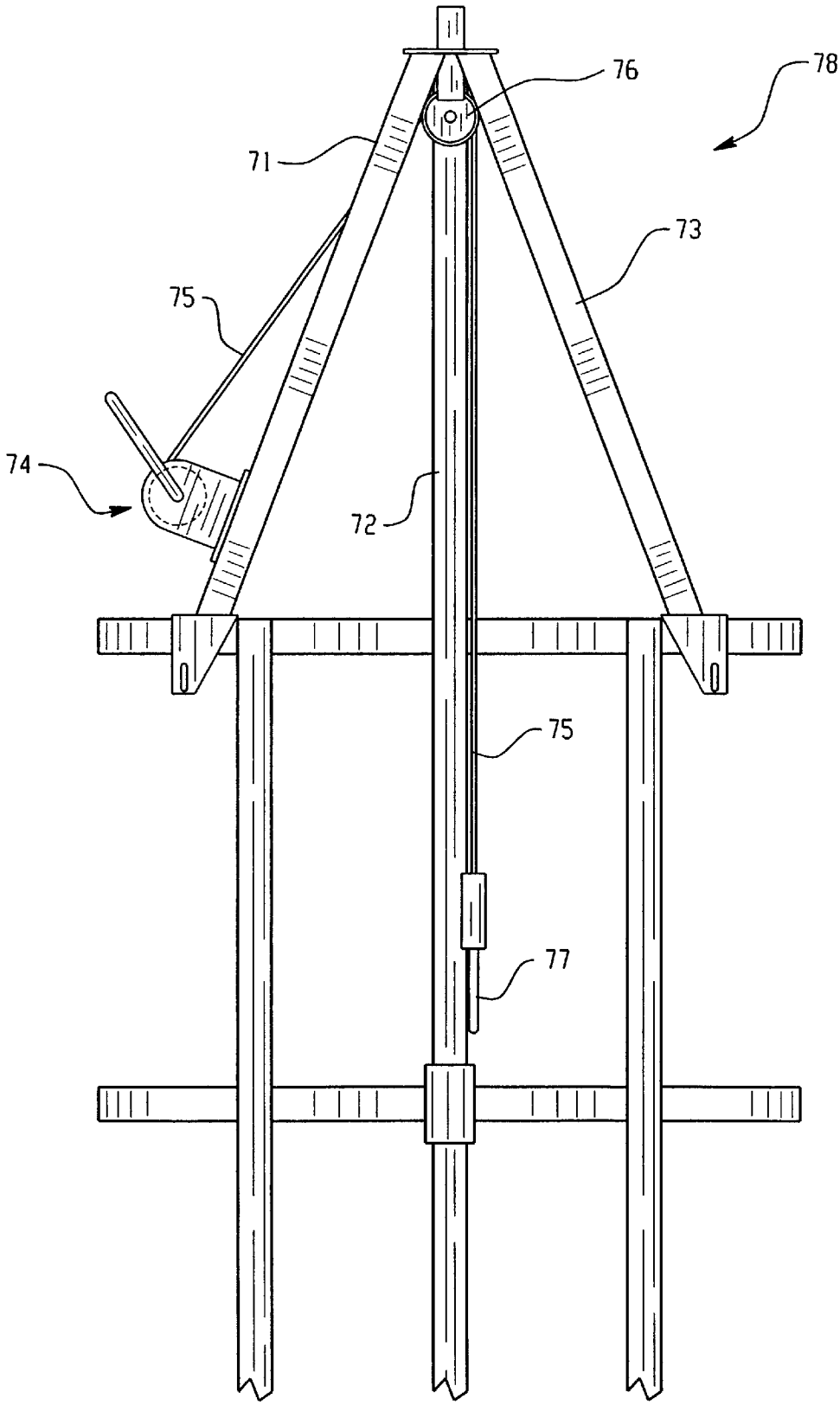
FIG. 16 is a front elevation view of the optional emergency egress frame of FIG. 15.

In yet another alternative embodiment shown in FIGS. 15 and 16, an optional emergency egress frame 78 may be attached to the retractable safety cage 10 at proximal end 21 of the main rail 20 or to the first periphery rail 40. The emergency egress frame 78 may take many shapes, including an A-frame assembly. The emergency egress frame 78 preferably comprises at least three supporting members 71, 72, 73 that are connected at their distal ends to the retractable safety cage 10, and are connected at their proximal ends to each other via a common joint or plate. Affixed to one of said support members 71, 72, 73 is a winch 74 having an extendable cable 75. The cable 75 preferably is routed across one or more pulleys 76 and terminates in a retrieval mechanism 77. In the preferred embodiment, the retrieval mechanism 77 is a hook. During use, the emergency egress frame 78 may be attached to the retractable safety cage 10 and the winch 74 may be operated so as to lower the retrieval mechanism 77 into the manhole 11. A person situated within the manhole 11 may then attach the retrieval mechanism 77 to either himself or an injured person. An operator on the surface then may operate the winch 74 so as to remove the injured person from the manhole 11. The emergency egress frame 78 is typically comprised of the same materials as the retractable safety cage 10.

While there has been described and illustrated particular embodiments of a retractable safety cage, it will be apparent to those skilled in the art that variations and modifications are possible without deviating from the broad spirit and principle of the present invention, which shall be limited solely by the scope of the claims appended hereto.

What is claimed is:

1. A retractable perimeter-defining safety cage for fixed ladders or subsurface openings comprising:

a) at least one adjustable guide bracket further comprising a slide housing connected to a guide bracket extension for attachment to said wall or said ladder;

b) at least two main rails having proximal ends and distal ends, wherein at least one of said at least two main rails is slideably mounted within said slide housing for sliding between a retracted position and an extended position;

c) a locking mechanism for engagement with said at least two main rails for releasably locking said retractable safety cage in either said extended position or said retracted position;

d) a counterbalance mounted to said at least one adjustable guide bracket and connected to said distal end of said at least one of said at least two main rails that provides a bias force in the direction of said extended position; and e) a fixed first periphery rail having a first end and a second end wherein said first end and said second end are connected to said proximal ends of said at least two main rails, and wherein said fixed first periphery rail defines a barrier adjacent said proximal ends of said at least two main rails in said extended position wherein said retractable safety cage further comprises a floating periphery rail having a first end and a second end wherein said first end and said second end are slideably attached to said at least two main rails and wherein said floating periphery rail is connected to said first periphery rail with non-rigid connects.

2. The retractable safety cage of claim 1, wherein said first periphery rail and said floating periphery rail are substantially horizontally disposed.

3. The retractable safety cage of claim 1, wherein said non-rigid connectors are selected from the group consisting of chains, cables, straps, and rope.

4. The retractable safety cage of claim 1, wherein said fixed first periphery rail provides an enclosure surrounding approximately 270 to 360 degrees.

5. The retractable safety cage of claim 4, wherein said first periphery rail comprises a back portion and at least two side portions that provide a substantially complete horizontal enclosure, and a front portion releasably connected to said at least two side portions wherein said first portion provides complete closure.

6. The retractable safety cage of claim 1, wherein said at least two main rails further comprise an opening at said distal ends for receiving said locking mechanism when said at least two main rails are in said extended position.

7. The retractable safety cage of claim 6, wherein said locking mechanism further comprises a spring-loaded pin that is movable between a disengaged position wherein said locking mechanism is not received in said opening of said distal ends, and an engaged position wherein said locking mechanism is received in said opening and wherein said spring-loaded pin is biased in said engaging position.

8. The retractable safety cage of claim 1, wherein said adjustable guide bracket further comprises a guide extension having a plurality of openings therethrough, wherein said openings may receive bolts for rigidly attaching said adjustable guide bracket to said ladder or said wall.

9. The retractable safety cage of claim 8, wherein said slide housing further comprises a bushing therewithin to facilitate said sliding movement of said at least two main rails between said extended position and said retracted position.

10. The retractable safety cage of claim 1, wherein said counterbalance is a pretensioned spring device having a tension force tending to maintain said main rails in said extended position.

11. The retractable safety cage of claim 10, wherein said pre-tensioned force on said counterbalance is sufficient to maintain said retractable safety cage in said extended position.

12. The retractable safety cage of claim 1, wherein said retractable safety cane provides a safety perimeter around said ladder or said wall enclosing approximately 270 to 360 degrees when said retractable safety cage is in said extended position.

13. The retractable safety cage of claim 2, wherein said retractable safety cage does not project substantially below said slide housing when said retractable safety cage is in said retracted position.

14. A retractable removable safety cage for mounting on a wall or ladder comprising:

(a) adjustable guide brackets further comprising a slide housing connected to a guide bracket extension for attachment to said ladder or wall;

(b) at least two main rails having proximal ends and distal ends, wherein said at least two main rails are slideably received within said slide housing for sliding between a retracted position and an extended position;

(c) a coupling foot further comprising a rail extension having a proximal end and a distal end wherein said distal end is affixed to a stop having a portion protruding outwardly from said rail extension, wherein said proximal end of said extension rail is open and fixedly receives a tab that extends longitudinally outwardly from said proximal end of said extension rail;

(d) a locking mechanism for releasably locking said retractable removable safety cage in either said extended position or said retracted position, and allowing said at least two main rails to be completely removed from said adjustable guide brackets;

(e) a counterbalance mounted to said adjustable guide bracket and connected to said foot that provides a bias force in the direction of said extended position; and (f) a fixed first periphery rail having a first end and a second end wherein said first end and said second end are connected to said proximal end of said main rails.

15. The retractable removable safety cage of claim 14, wherein said retractable removable safety cage further comprises a floating periphery rail having a first end and a second end wherein said first end and said second ends are slideably attached to said at least two main rails and wherein said floating periphery rail is connected to said first periphery rail with non-rigid connectors.

16. The retractable removable safety cage of claim 14, wherein said tabs of said foot are inserted into said distal end of said at least two main rails, thereby coupling said at least two main rails to said adjustable guide bracket.

17. The retractable removable safety cage of claim 16, wherein said tab comprises at least one longitudinally extending member having a length of approximately 2 to approximately 10 inches.

18. The retractable removable safety cage of claim 16, wherein said foot receives said distal end of said main rail so that as said main rail slides within said slide housing between said extended position and said retracted position, said foot and said main rail slide as one unit.

19. The retractable removable safety cage of claim 14, wherein said guide bracket extension contains a plurality of openings therethrough, wherein said openings may receive bolts therethrough for rigidly attaching said adjustable guide bracket to said ladder or said wall.

20. The retractable removable safety cage of claim 14, wherein said slide housing further comprises a bushing therewithin to facilitate said sliding movement of said at least two main rails between said extended position and said retracted position.

21. The retractable removable safety cage of claim 20, wherein said bushing is made from a material selected from the group consisting of straight chained polymers and cross linked polymers.

22. The retractable removable safety cage of claim 21, wherein said bushing is made from nylon.

23. The retractable removable safety cage of claim 20, wherein said bushing is made from a material selected from the group consisting of composites of carbon, cellulose, and glass.

24. The retractable removable safety cage of claim 15, wherein said first periphery rail and said floating periphery rail are substantially horizontally disposed.

25. The retractable removable safety cage of claim 15, wherein said non-rigid connectors are selected from the group consisting of chains, rope, cables, and straps.

26. The retractable safety cage of claim 14, wherein said fixed first periphery rail provides an enclosure surrounding approximately 270 to 360 degrees.

27. The retractable safety cage of claim 26, wherein said first periphery rail comprises a back portion and at least two side portions that provide a substantially complete horizontal enclosure, and a front portion releasably connected to said at least two side portions wherein said first portion provides complete closure.

28. The retractable safety cage of claim 14, wherein said at least two main rails further comprise an opening at said distal end for receiving said locking mechanism when said at least two main rails are in said extended position.

29. The retractable safety cage of claim 28, wherein said locking mechanism further comprises a spring-loaded pin that is movable between a disengaged position wherein said locking mechanism is not received in said opening of said distal end, and an engaged position wherein said locking mechanism is received in said opening and wherein said spring-loaded pin is biased in said engaging position.

30. The retractable safety cage of claim 14, wherein said adjustable guide bracket further comprises a guide extension having a plurality of openings therethrough, wherein said openings may receive bolts therethrough for rigidly attaching said adjustable guide bracket to said ladder or said wall.

31. The retractable safety cage of claim 30, wherein said slide housing further comprises a bushing therewithin to facilitate said sliding movement of said main rails between said extended position and said retracted position.

32. The retractable safety cage of claim 14, wherein said counterbalance is a pretensioned spring device having a tension force tending to maintain said main rails in said extended position.

33. The retractable safety cage of claim 32, wherein said pre-tensioned force on said counterbalance is sufficient to maintain said/retractable safety cage in said extended position.

34. The retractable safety cage of claim 14, wherein said retractable safety cage provides a safety perimeter around said ladder or said wall when said retractable safety cage is in said extended position.

35. The retractable safety cage of claim 14, wherein said retractable safety cage occupies a minimal amount of vertical space near the top of said ladder or said wall when said retractable safety cage is in said retracted position.

36. The retractable safety cage of claim 14 wherein said locking mechanism further comprises a lever having a proximal end and a distal end, wherein said distal end is coupled to a retaining arm that is pivotally coupled to said adjustable guide bracket.

37. The retractable safety cage of claim 36 wherein said retaining arm pivots alternately between a locking position wherein said retaining arm receives said distal end of said coupling foot thereby preventing further movement beyond said extended position, and an unlocking position wherein said retaining arm is moved away from said distal end of said coupling foot upon pulling said proximal end of said lever.

38. A retractable removable safety cage for mounting on a wall or ladder comprising:

(a) adjustable guide brackets further comprising a slide housing connected to a guide bracket extension for attachment to said ladder or wall;

(b) at least two main rails having proximal ends and distal ends, wherein said at least two main rails are slideably received within said slide housing for sliding between a retracted position arid an extended position;

(c) a coupling foot further comprising a rail extension having a proximal end and a distal end wherein said distal end is affixed to a stop having a portion protruding outwardly from said rail extension, wherein said proximal end of said extension rail is open and fixedly receives a tab that extends longitudinally outwardly from said proximal end of said extension rail;

(d) a releasable locking mechanism for releasably locking said retractable removable safety cage in either said extended position or said retracted position, and allowing said at least two main rails to be completely removed from said adjustable guide brackets;

(e) a counterbalance mounted to said adjustable guide bracket and connected to said foot that provides a bias force in the direction of said extended position;

(f) a fixed first periphery rail having a first end and a second end wherein said first end and said second end are connected to said proximal end of said main rails; and (g) a floating periphery rail having a first end and a second end wherein said first end and said second end are slideably attached to said at least two main rails and wherein said floating periphery rail is connected to said at first periphery rail with non-rigid connectors.

39. In combination with the retractable removable safety cage of claim 38, an emergency egress frame comprising at least three support members having proximal and distal ends wherein said at least three support members are connected at said distal ends to said retractable removable safety cage and at said proximal ends to a common plate.

40. The emergency egress frame of claim 39 wherein said emergency egress frame further comprises a winch assembly connected thereto for lifting objects from an opening thereunder.

41. A retractable removable safety cage for fixed ladders or subsurface openings comprising:

(a) a first adjustable guide bracket and a second adjustable guide bracket, said first adjustable guide bracket further comprising a first slide housing connected to a first guide bracket extension for attachment to said fixed ladder or a wall within said subsurface opening, and said second adjustable guide bracket further comprising a second slide housing connected to a second guide bracket extension for attachment to said fixed ladder or a wall within said subsurface opening;

(b) a first main rail and a second main rail, each of said first and second main rails having proximal ends and distal ends, wherein said first main rail is slideably received within said first slide housing and wherein said second main rail is slideably received within said second slide housing for sliding between a retracted position and an extended position;

(c) a coupling foot for either said first main rail or said second main rail further comprising a rail extension having a proximal end and a distal end, wherein said coupling foot a said distal end further comprise a stop having a portion protruding outwardly from said rail extension, wherein said proximal end of said rail extension is fixed to said distal end of said first or second main rail;

(d) a locking mechanism for releasably locking said retractable removable safety cage in either said extended position or said retracted position, and allowing said first and second main rails to be completely removed from said first and second adjustable guide brackets;

(e) a counterbalance mounted to said first or second adjustable guide bracket and connected to said coupling foot that provides a bias force in the direction of said extended position; and (f) a fixed first periphery rail having a first end and a second end wherein said first end and said second end are connected to said proximal end of said first and second main rails.

42. The retractable removable safety cage of claim 41, wherein said retractable removable safety cage further comprises a floating periphery rail having a first end and a second end wherein said first end and said second ends are slideably attached to said first and second main rails and wherein said floating periphery rail is connected to said first periphery rail with non-rigid connectors.

43. The retractable removable safety cage of claim 41, wherein said proximal end of said coupling foot further comprises a tab that longitudinally engages said distal end of said first or second main rails, thereby coupling said first or second main rails to said first or second adjustable guide brackets.

44. The retractable removable safety cage of claim 43, wherein said tab comprises at least one longitudinally extending member having a length of approximately 2 to approximately 10 inches.

45. The retractable removable safety cage of claim 43, wherein said coupling foot receives said distal end of said first or second main rails so that as said first or second main rail slides within said first or second slide housing between said extended position and said retracted position, said coupling foot and said first or second main rail slide as one unit.

46. The retractable removable safety cage of claim 41, wherein said first and second guide bracket extensions contain a plurality of openings therethrough, wherein said openings may receive bolts therethrough for rigidly attaching said adjustable guide bracket to said ladder or said wall.

47. The retractable removable safety cage of claim 41, wherein said first and second slide housings further comprise a bushing therewithin to facilitate said sliding movement of said first and second main rails between said extended position and said retracted position.

48. The retractable removable safety cage of claim 47, wherein said bushing is made from a material selected from the group consisting of straight chained polymers and cross linked polymers.

49. The retractable removable safety cage of claim 48, wherein said bushing is made from nylon.

50. The retractable removable safety cage of claim 49, wherein said bushing is made from a material selected from the group consisting of composites of carbon, cellulose, and glass.

51. The retractable removable safety cage of claim 42, wherein said first periphery rail and said floating periphery rail are substantially horizontally disposed.

52. The retractable removable safety cage of claim 42, wherein said non-rigid connectors are selected from the group consisting of chains, rope, cables, and straps.

53. The retractable safety cage of claim 41, wherein said fixed first periphery rail provides an enclosure surrounding approximately 270 to 360 degrees.

54. The retractable safety cage of claim 53, wherein said first periphery rail comprises a back portion and at least two side portions that provide a substantially complete horizontal enclosure, and a front portion releasably connected to said at least two side portions wherein said first portion provides complete closure.

55. The retractable safety cage of claim 41, wherein said first and second main rails further comprise an opening at said distal ends for receiving said locking mechanism when said first and second main rails are in said extended position.

56. The retractable safety cage of claim 55, wherein said locking mechanism further comprises a spring-loaded pin that is movable between a disengaged position wherein said locking mechanism is not received in said opening of said distal end, and an engaged position wherein said locking mechanism is received in said opening and wherein said spring-loaded pin is biased in said engaging position.

57. The retractable safety cage of claim 41, wherein said first and second adjustable guide brackets further comprise a guide extension having a plurality of openings therethrough, wherein said openings may receive bolts therethrough for rigidly attaching said adjustable guide bracket to said ladder or said wall.

58. The retractable safety cage of claim 57, wherein said first and second slide housings further comprise a bushing therewithin to facilitate said sliding movement of said first and second main rails between said extended position and said retracted position.

59. The retractable safety cage of claim 41, wherein said counterbalance is a pretensioned spring device having a tension force tending to maintain said first and second main rails in said extended position.

60. The retractable safety cage of claim 59, wherein said pre-tensioned force on said counterbalance is sufficient to maintain said retractable safety cage in said extended position.

61. The retractable safety cage of claim 41, wherein said retractable safety cage provides at least about a 270 degree safety perimeter around said fixed ladder or subsurface opening when said retractable safety cage is in said extended position.

62. The retractable safety cage of claim 41, wherein said retractable safety cage does not project substantially below said first or second slide housing when said retractable safety cage is in said retracted position.

* * * * *

UNITED STATES PATENT AND TRADEMARK OFFICE

CERTIFICATE OF CORRECTION

PATENT NO. : 6,607,053 B1
DATED : August 19, 2003
INVENTOR(S) : William Paul Warren It is certified that error appears in the above-identified patent and that said Letters Patent is hereby corrected as shown below:

Column 16,
Line 4, replace “comprise” with -- comprises --
Line 5, replace “a” with -- at --

Column 17,
Line 7, replace “fixed” with -- coupled --

Signed and Sealed this

Seventh Day of October, 2003

JAMES E. ROGAN
*Director of the United States Patent and Trademark Office*